US010767371B1

(12) United States Patent
Ramsey

(10) Patent No.: US 10,767,371 B1
(45) Date of Patent: Sep. 8, 2020

(54) SNOW RAKE

(71) Applicant: Mark C. Ramsey, Omaha, NE (US)

(72) Inventor: Mark C. Ramsey, Omaha, NE (US)

( * ) Notice: Subject to any disclaimer, the term of this patent is extended or adjusted under 35 U.S.C. 154(b) by 0 days.

(21) Appl. No.: 16/130,216

(22) Filed: Sep. 13, 2018

(51) Int. Cl.
*E04D 13/10* (2006.01)

(52) U.S. Cl.
CPC ..... *E04D 13/106* (2013.01)

(58) Field of Classification Search
CPC ..... E04D 13/106; E01H 5/02; E01H 5/061; E01H 5/06; E01H 5/068; B08G 1/005; A01B 1/022; A01B 1/22; A01B 1/222
See application file for complete search history.

(56) References Cited

U.S. PATENT DOCUMENTS 157,078 A * 11/1874 Parker et al. ..... E01H 5/02 37/274
323,656 A * 8/1885 Franz ..... E01H 5/067 37/274
731,419 A * 6/1903 Wykoff ..... E01H 5/06 37/273
956,896 A * 5/1910 Gross ..... E01H 5/06 37/273
1,276,672 A * 8/1918 Mason, Jr. ..... E01H 5/06 37/273
1,307,410 A * 6/1919 Morris ..... E01H 5/06 37/273
1,820,692 A * 8/1931 Cooper ..... E01H 5/02 37/274
2,432,780 A * 12/1947 Mader ..... E01H 5/02 37/273
2,552,016 A * 5/1951 Mann ..... A01D 7/04 56/400.04
3,431,661 A * 3/1969 Carlson ..... E01H 5/02 37/273
3,526,979 A * 9/1970 Ladewski ..... E01H 5/02 37/273
3,773,375 A * 11/1973 Nehls ..... E04D 13/106 37/268
4,054,313 A * 10/1977 Ciuci ..... A01D 7/00 294/53.5
4,550,943 A * 11/1985 Mirto ..... E01H 5/02 294/50.8
4,796,367 A * 1/1989 Kulat ..... E01H 5/02 37/273
5,465,510 A 11/1995 Goodnough et al.
(Continued)

*Primary Examiner* — Robert E Pezzuto
*Assistant Examiner* — Joan D Misa
(74) *Attorney, Agent, or Firm* — Dennis L. Thomte; Thomte Patent Law Office LLC

(57) ABSTRACT

A snow rake for moving snow from a roof is disclosed. The snow rake includes an elongated extension pole comprising a plurality of pole sections which may be connected together in an end-to-end manner. First and second rake members are secured to the upper end of the extension pole. The first and second rake members are hingedly connected together so as to be able to be positioned in a straight position or a V-shaped position. Pivot support arms extend from the rake members to a clamp which is longitudinally adjustably secured to the extension pole. The clamp may be adjustably moved on the extension pole to change the positions of the rake members. The components of the snow rake may be placed in a box for display, shipment or storage.

1 Claim, 9 Drawing Sheets

(56) References Cited

U.S. PATENT DOCUMENTS

| | | | | |
|---|---|---|---|---|
| 5,511,328 | A * | 4/1996 | Fingerer | E01H 5/02 294/54.5 |
| 5,676,413 | A * | 10/1997 | Hauck | E04D 13/106 294/54.5 |
| 5,791,072 | A * | 8/1998 | Schbot | E01H 5/02 294/57 |
| 6,269,558 | B1 * | 8/2001 | Alexander | E01H 5/02 294/54.5 |
| 6,338,210 | B1 * | 1/2002 | Mele | E04D 13/0765 294/54.5 |
| 7,856,802 | B2 * | 12/2010 | Thibault | A01D 7/04 56/400.04 |
| 8,347,528 | B1 * | 1/2013 | Seltzer | E04D 13/106 172/371 |
| 9,049,918 | B2 * | 6/2015 | Perelli | A46B 5/0033 |
| 9,120,217 | B2 | 9/2015 | Fischer, Jr. et al. | |
| 9,340,981 | B1 * | 5/2016 | Gardner | E04D 13/106 |
| 9,611,603 | B2 * | 4/2017 | Fernandez, Sr. | E01H 5/061 |
| 2007/0028487 | A1 * | 2/2007 | Larson | E01H 5/02 37/278 |
| 2009/0013564 | A1 * | 1/2009 | Mallaridas | E01H 5/02 37/273 |
| 2012/0049551 | A1 * | 3/2012 | Tremblay | E01H 5/02 294/54.5 |
| 2013/0139414 | A1 * | 6/2013 | Hogenson | E01H 5/02 37/266 |
| 2015/0330044 | A1 * | 11/2015 | Ramcharan | E01H 5/02 37/284 |

* cited by examiner

SNOW RAKE

BACKGROUND OF THE INVENTION

Field of the Invention

This invention relates to a snow rake for moving snow from roofs or similar surfaces. More particularly, this invention relates to a snow rake which includes an adjustable V-shaped blade assembly having an elongated pole secured thereto. Even more particularly, this invention relates to a snow rake which may be disassembled to enable the snow rake, in its disassembled form, being able to be placed in a relatively small box for display, shipment or storage.

Description of the Related Art

Many types of snow rakes have been previously provided to enable a home owner or the like to rake accumulated snow from roofs to prevent "an ice dam" from forming along the eaves of a building. To the best of Applicant's knowledge, the majority of the prior art snow rakes include an elongated pole having a transversely disposed rake portion secured to the upper end thereof. The prior art snow rakes are quite large even when the pole is disconnected from the rake portion. This makes it difficult to place the snow rake in a box which is large and difficult to display, ship or for storage. Further, to the best of Applicant's knowledge, the blades of the prior art snow rakes are straight and not able to be positioned in a V-shape.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A rake is disclosed for moving snow from roofs. The rake includes an upstanding and rectangular-shaped first rake member having an outer end, an inner end, an upper end, a lower end, an inner side and an outer side. The rake also includes an upstanding and rectangular-shaped second rake member having an outer end, an inner end, an upper end, a lower end, an inner side and an outer side. The inner ends of the first and second rake members are hingedly secured together about a substantially vertically disposed axis.

Each of the first and second rake members are selectively movable between a first position, a second position and a third position. The first and second rake members, when in the first position, are substantially parallel to one another in an end-to-end manner. The first and second rake members, when in the second position, are angularly disposed with respect to one another.

A connector is positioned between the inner ends of the first and second rake members and is secured thereto. The invention also includes an extension pole, having upper and inner ends, with the extension pole being comprised of a plurality of pole sections. The upper end of the extension pole is selectively threadably secured to the connector. The rake also includes an elongated and rigid first support arm having an inner end and an outer end with the outer end of the first support arm being hingedly secured to the first rake member at the outer end of the first rake member. The inner end of the first support arm is hingedly and selectively longitudinally adjustably secured to the extension pole. The rake also includes an elongated and rigid second support arm having an inner end and an outer end. The outer end of the second support arm is hingedly secured to the second rake member at the outer end of the second rake member. The inner end of the second support arm is hingedly and selectively longitudinally adjustably secured to the extension pole.

As stated above, the first and second rake members are also selectively movable to a third position. In the third position, the outer side of the first rake member is positioned adjacent the outer side of the second rake member. The inner ends of the first and second support arms are disconnected from the extension pole to permit the first and second rake members to be moved to the third position.

The fact that the first and second rake members are selectively movable to the third position as described, and wherein the extension pole is comprised of a plurality of pole sections, permits the entire rake to be placed in a relatively small box for display, shipment, storage, etc.

A principal object of the invention is to provide an improved snow rake for moving snow from the roof of a home, building, etc.

A further object of the invention is to provide an improved snow rake wherein the rake members thereof may be selectively adjusted between a substantially straight position to a V-shaped position.

A further object of the invention is to provide an improved snow rake wherein the snow rake, when disassembled, may be placed in a relatively small box for display, storage, shipment, etc.

A further object of the invention is to provide an improved snow rake which is easily assembled and easily disassembled.

Yet another object of the invention is to provide an improved snow rake which is more efficient and easy to use than the snow rakes of the prior art.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
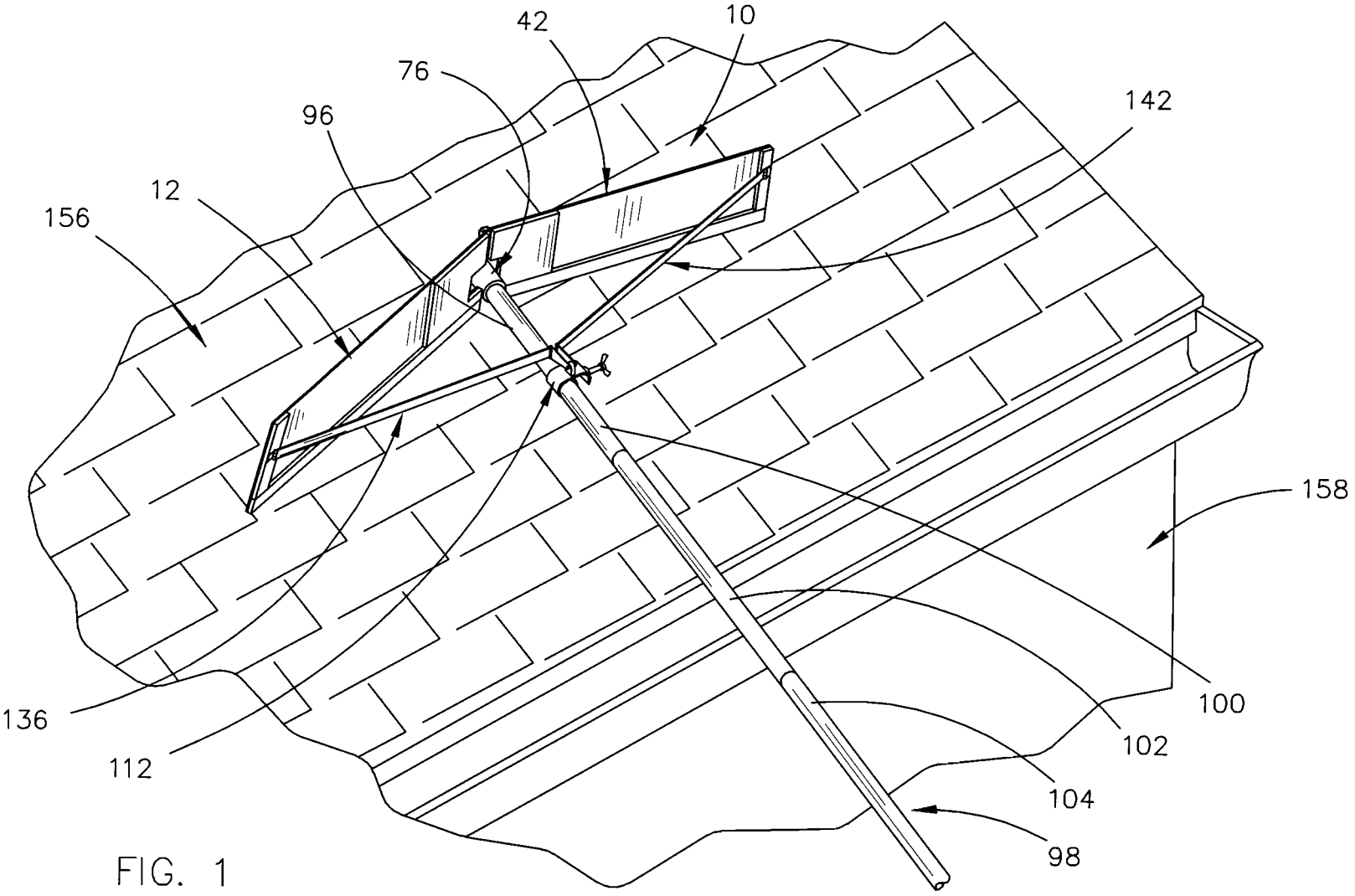
FIG. 1 is a partial perspective view of the snow rake of this invention being positioned on the roof of a building.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The snow rake of this invention is designated with the reference numeral 10. Snow rake 10 includes a first upstanding rake member 12 having an outer end 14, an inner end 16, an upper end 18, a lower end 20, an inner side 22 and an outer side 24. The inner side 22 of rake member 12 has a vertically disposed support member 26 secured thereto by bolts 28 or any other convenient means at end 14 of rake member 12. The inner side 22 of rake member 12 has a horizontally disposed support member 30 secured thereto at lower end 20 thereof by bolts 32 or any other convenient means. The inner side 22 of rake member 12 has a vertically disposed support member or plate 34 secured thereto at end 16 thereof by bolts 36 or any other convenient means.

Rake member 12 and the support members 26, 30 and 34 may be constructed of plastic or a metal material such as aluminum. A hinge mount 38 is secured to the outer end 14 of rake member 12 and support member 26 by screws, bolts or any other convenient means. Mount 38 includes a vertically disposed hinge member 40.

Snow rake 10 also includes a second upstanding rake member 42 having an outer end 44, an inner end 46, an upper end 48, a lower end 50, an inner side 52 and an outer side 54. The inner side 52 of rake member 42 has a vertically disposed support member 56 secured thereto by bolts 58 or any other convenient means at end 44 of rake member 42. The inner side of rake member 42 has a horizontally disposed support member 60 secured thereto at lower end 50 thereof by bolts 62 or any other convenient means. The inner side of rake member 42 has a vertically disposed support member or plate 64 secured thereto at end 46 thereof by bolts 66 or any other convenient means.

Rake member 42 and the support members 56, 60 and 64 may be constructed of plastic or a metal material such as aluminum. A hinge mount 68 is secured to the outer end 44 of rake member 42 and support member 56 by screws, bolts or any other convenient means. Mount 68 includes a vertically disposed hinge member 70.

The inner end 16 of rake member 12 has a notch or opening 72 formed therein. The inner end 46 of rake member 42 has a notch or opening 74 formed therein so as to be aligned with notch 72. A connector 76 is positioned in notches 72 and 74 and has an internally threaded rearward end 77. A hinge member 78 is secured to the outer side 24 of rake member 12 at the upper end thereof by bolts 80. A hinge member 82 is secured to the outer side 54 of rake member 42 at the upper end thereof by bolts 84. The hinge barrels of the hinge members 78 and 82 hingedly mesh with one another to form a hinge connection between rake members 12 and 42. A hinge member 86 is secured to the outer side 24 of rake member 12 at the lower end of rake member 12 by bolts 88. A hinge member 90 is secured to the outer side 54 of rake member 42 by bolts 92. The hinge barrels of hinge members 86 and 90 hingedly mesh with one another to form a hinge connection between rake members 12 and 42. A hinge bolt or pin 94 extends through the barrels of hinge members 78 and 82, through an opening 95 in the forward end of connector 76 and through the barrels of hinge members 86 and 90.

The numeral 96 refers to the upper pole section of the extension pole 98 which is comprised of pole sections 96, 100, 102, 104, and 106 which may be connected together in conventional fashion. The lower end of pole section 106 has a handle 108 thereon. The outer end of pole section 96 has a threaded portion 110 which is selectively threadably secured to the internally threaded rearward end 77 of connector 76.

The numeral 112 refers to a plastic support which is selectively longitudinally movably clamped onto the pole section 96 and/or the pole section 100. Support 112 includes a body portion 114 which includes a base portion 116 and arcuate side members 118 and 120. Side member 120 has an internally threaded plastic nut 122 molded therewith. A bolt 124 is threadably mounted in nut 122 and has an inner end (not shown) and a wing-shaped outer end 128. The inner end of bolt 124 is secured to a curved clamp member 130 whereby threadable movement of bolt 124 will cause movement of clamp member 130. A mount 132 extends outwardly and upwardly from base portion 116 and has an opening 134 formed therein. Support 112 is configured to be selectively longitudinally clamped onto either the pole section 96 and/or the pole section 100 as set forth above.

The numeral 136 refers to an elongated adjustment arm having an outer end 138 and an inner end 140. The outer end 138 of arm 136 is secured to hinge member 40 of hinge mount 38 at the outer end 14 of rake member 12. The numeral 142 refers to an elongated adjustment arm having an outer end 144 and an inner end 146. The outer end 144 of arm 142 is secured to hinge member 70 of hinge mount 68 at the outer end of rake member 42. The inner end 140 of arm 136 has one end of a hinge 148 secured thereto. The inner end 146 of arm 142 has one end of a hinge 150 secured thereto. The other ends of hinges 148 and 150 are secured to mount 132 by means of a bolt 152 which extends through the ends of hinges 148 and 150 and through opening 134. Nut 154 is threadably secured to the bolt 152. Snow rake 10 is designed to move snow from a roof 156 of a building 158 as will now be described.

Figure 2:
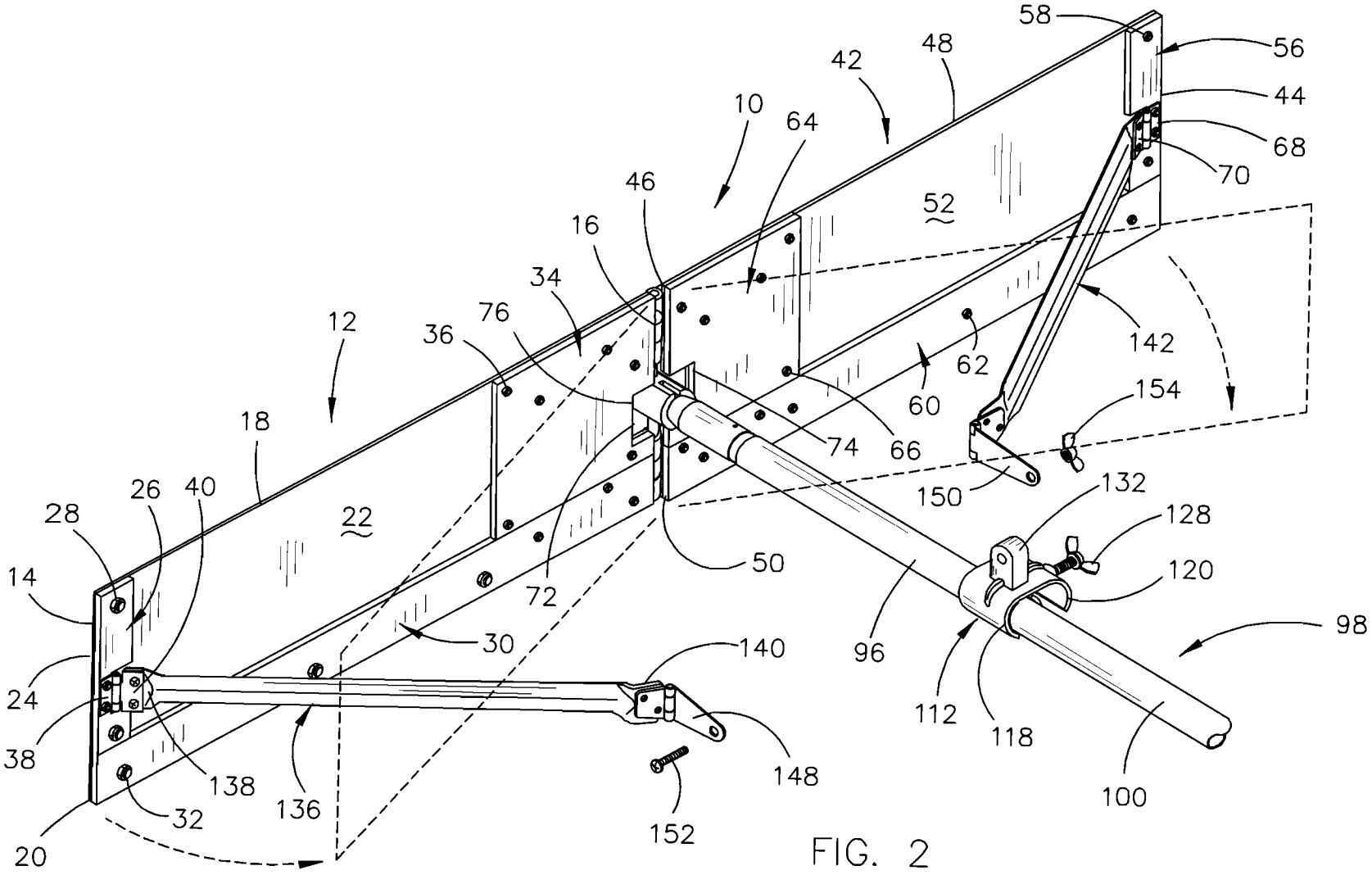
FIG. 2 is a partial rear perspective view of the snow rake of this invention.
Figure 3:
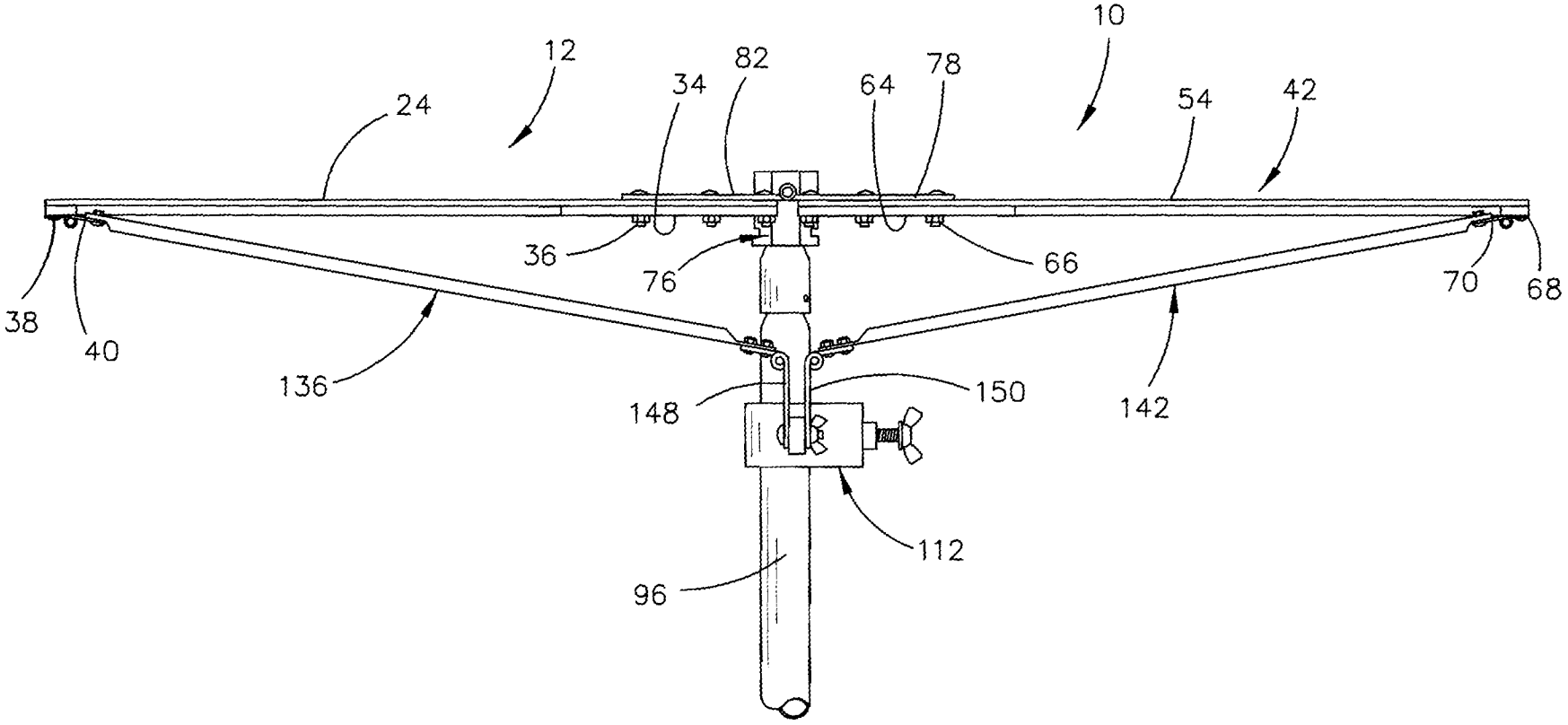
FIG. 3 is a partial top view of the snow rake of this invention wherein the first and second rake members thereof are positioned in an end-to-end manner.
Figure 4:
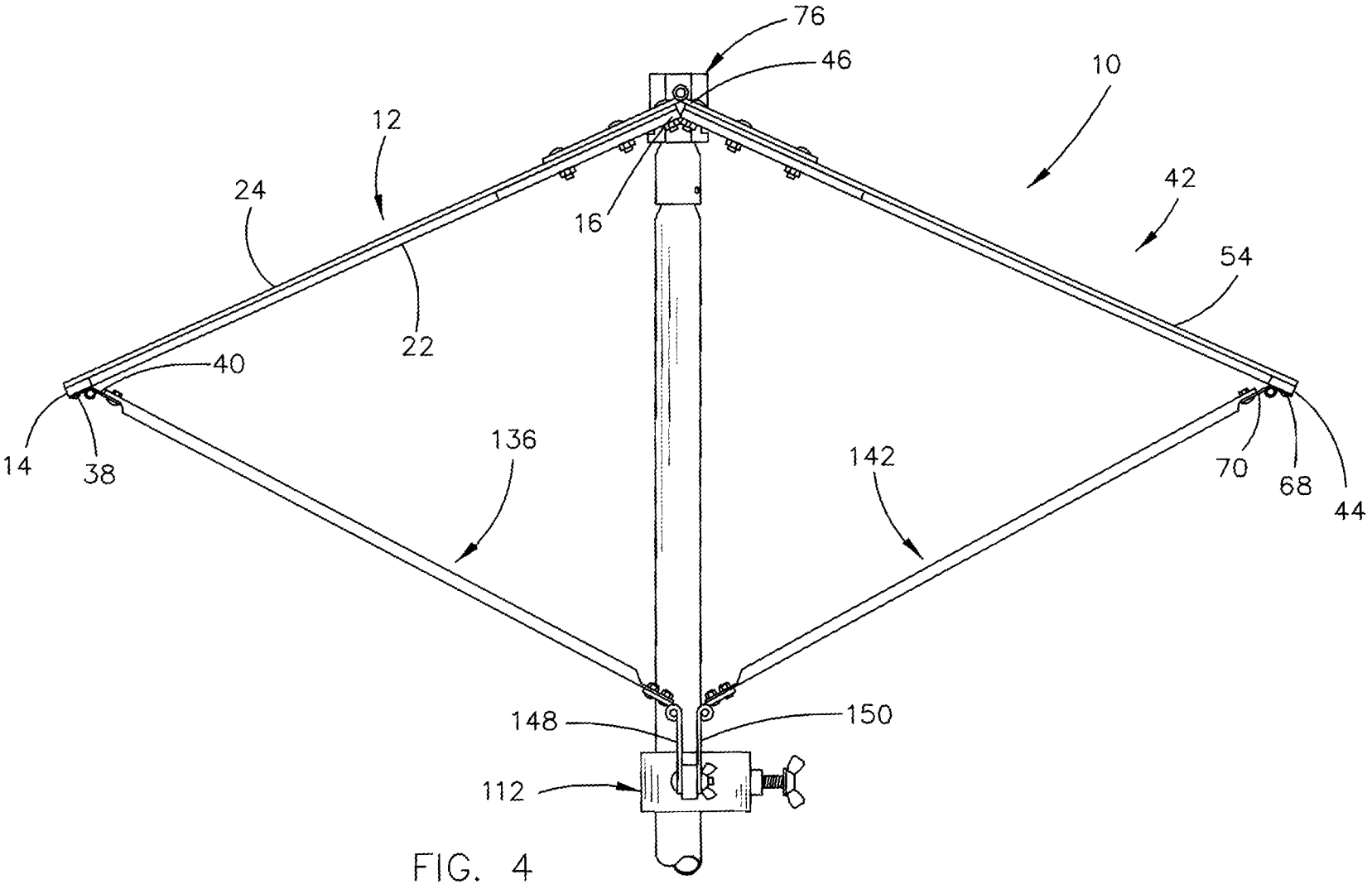
FIG. 4 is a partial top view of the snow rake of this invention wherein the rake members thereof are angularly disposed.
Figure 5:
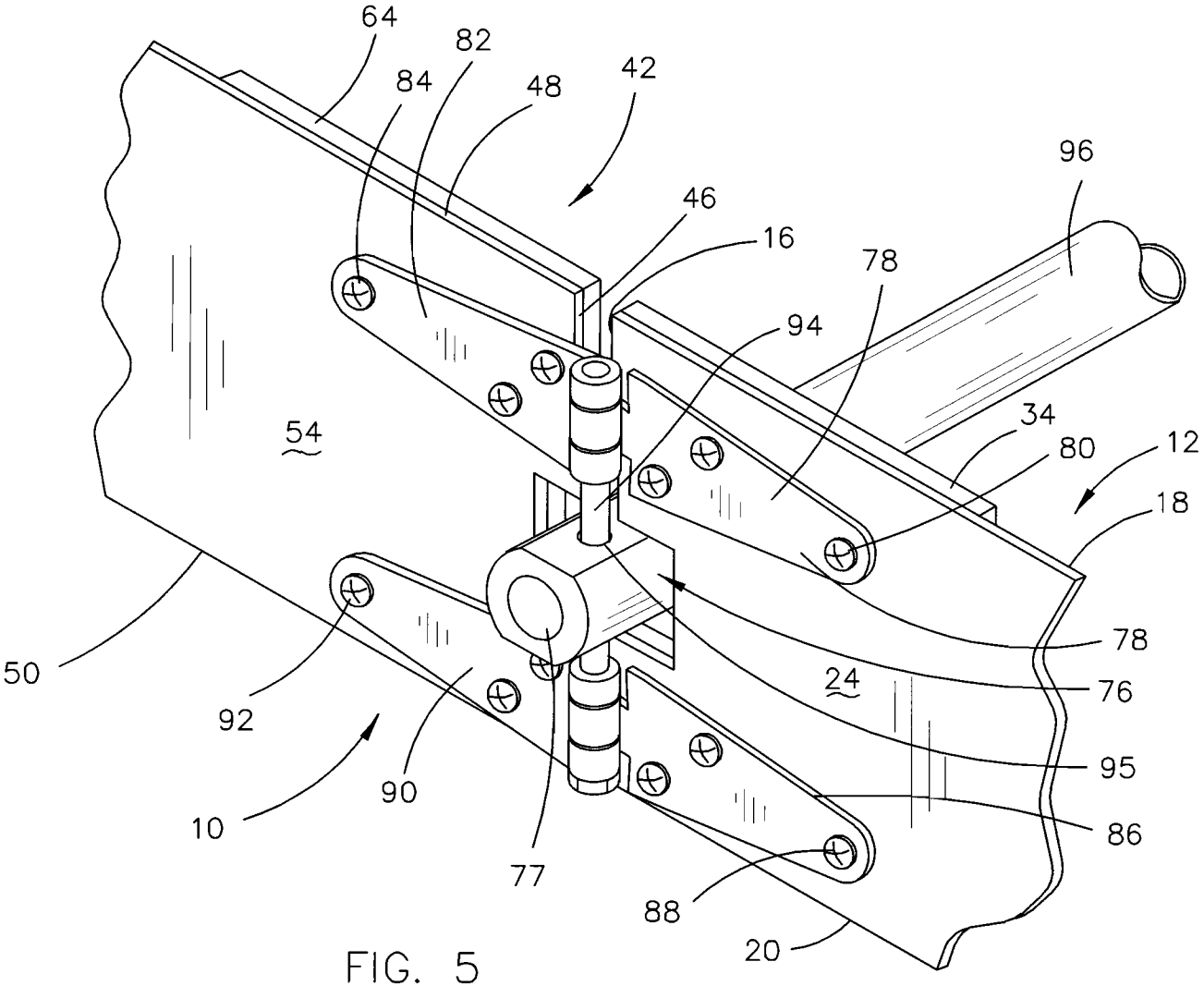
FIG. 5 is a partial upper front perspective view of the first and second rake members thereof which illustrates the hinged connection at the inner ends of the first and second rake members.
Figure 6:
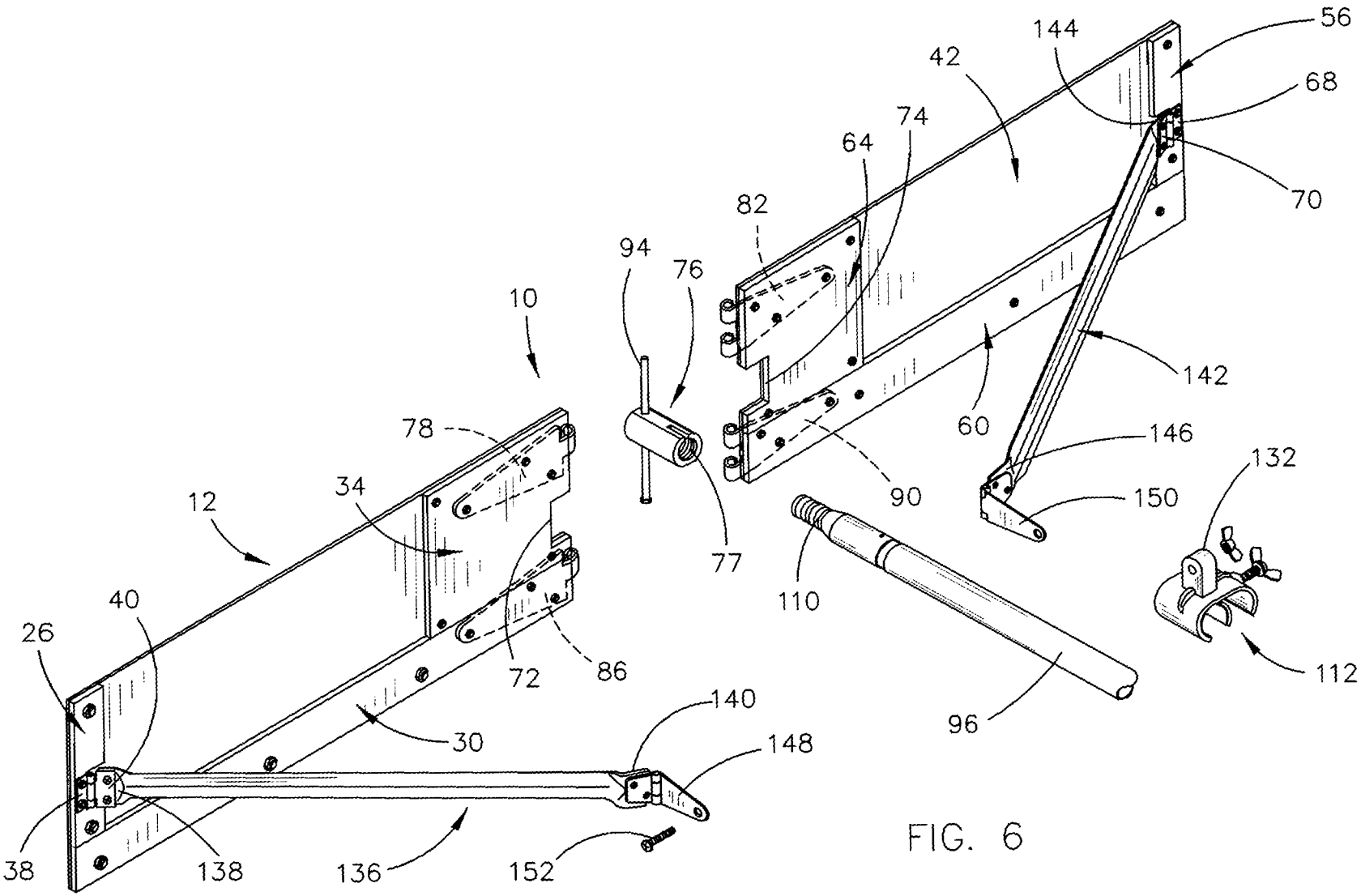
FIG. 6 is a partial exploded rear perspective view of the snow rake invention.
Figure 7:
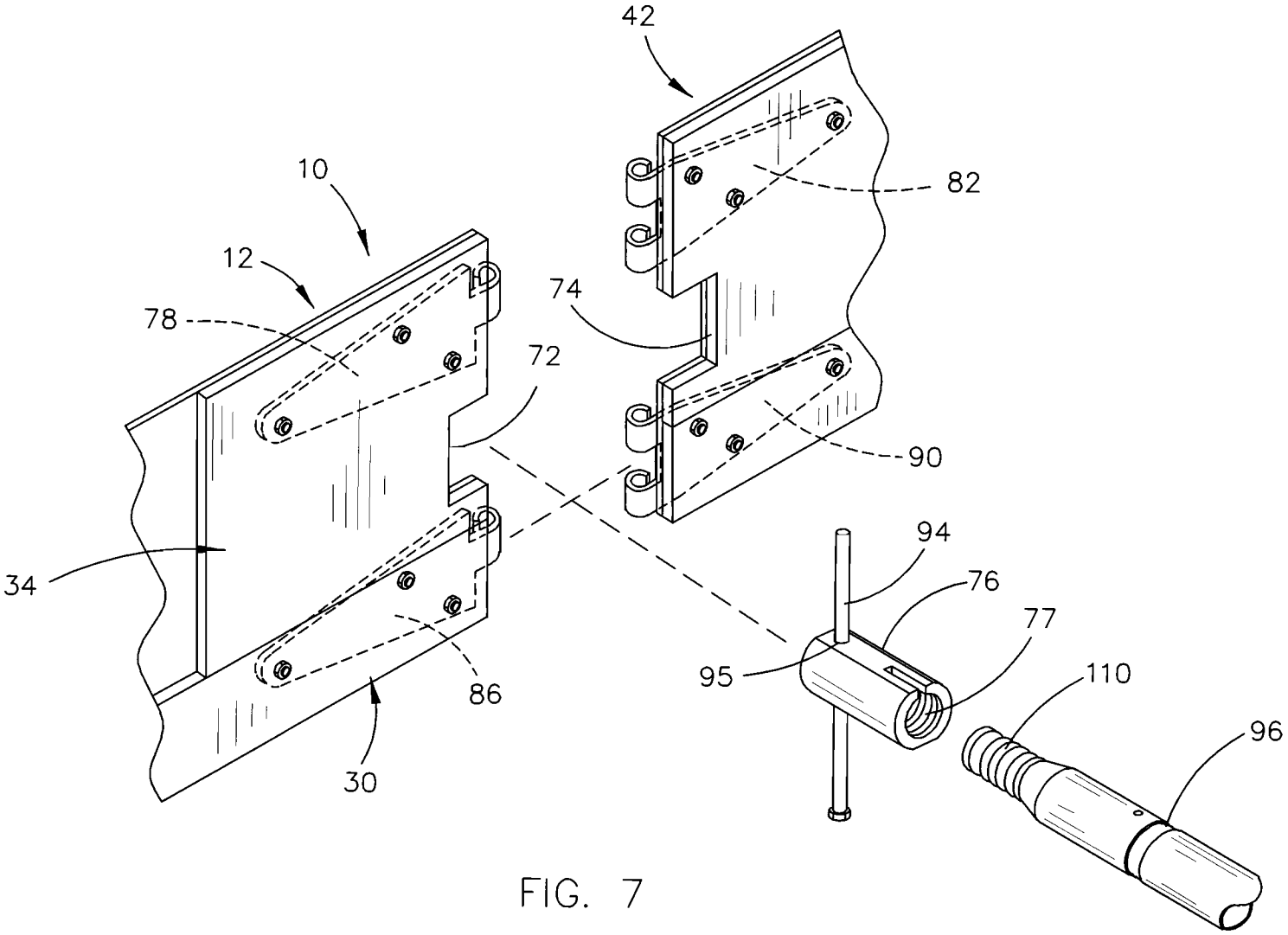
FIG. 7 is a partial exploded rear perspective view of the snow rake invention.
Figure 8:
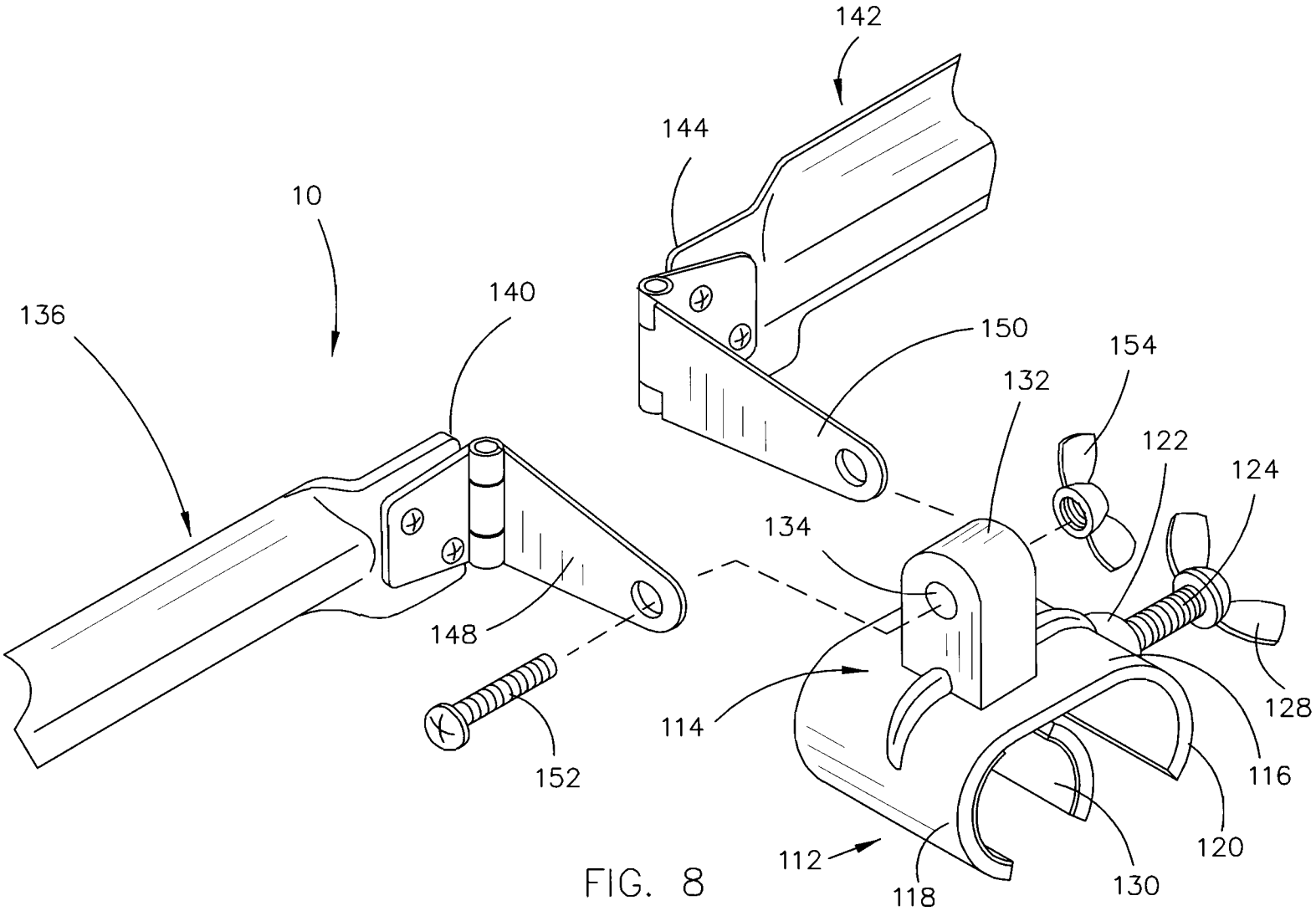
FIG. 8 is a partial exploded rear perspective view of the snow rake invention.

The user of the snow rake 10 will assemble the components of the snow rate 10 as described above. The rake members 12 and 42 may be positioned in the end-to-end manner as shown in FIG. 2 by adjusting the position of the support 112 on the extension pole 98. The inner ends of adjustment arms 136 and 142 will be secured to the support 112 by the bolt 152 to maintain the rake members 12 and 42 in the end-to-end manner of FIG. 2. If the user desires to position the rake members 12 and 42 in a V-shape, such as seen in FIG. 4, the support 112 will be longitudinally adjustably moved downwardly on the extension pole 98 to the desired position and clamped onto the extension pole 98. In either case, the user will position the snow rake 10 on the roof 156 as seen in FIG. 1. The user will then pull the extension pole 98 downwardly so that the rake members 12 and 42 will move the snow from the roof 156.

Figure 9:
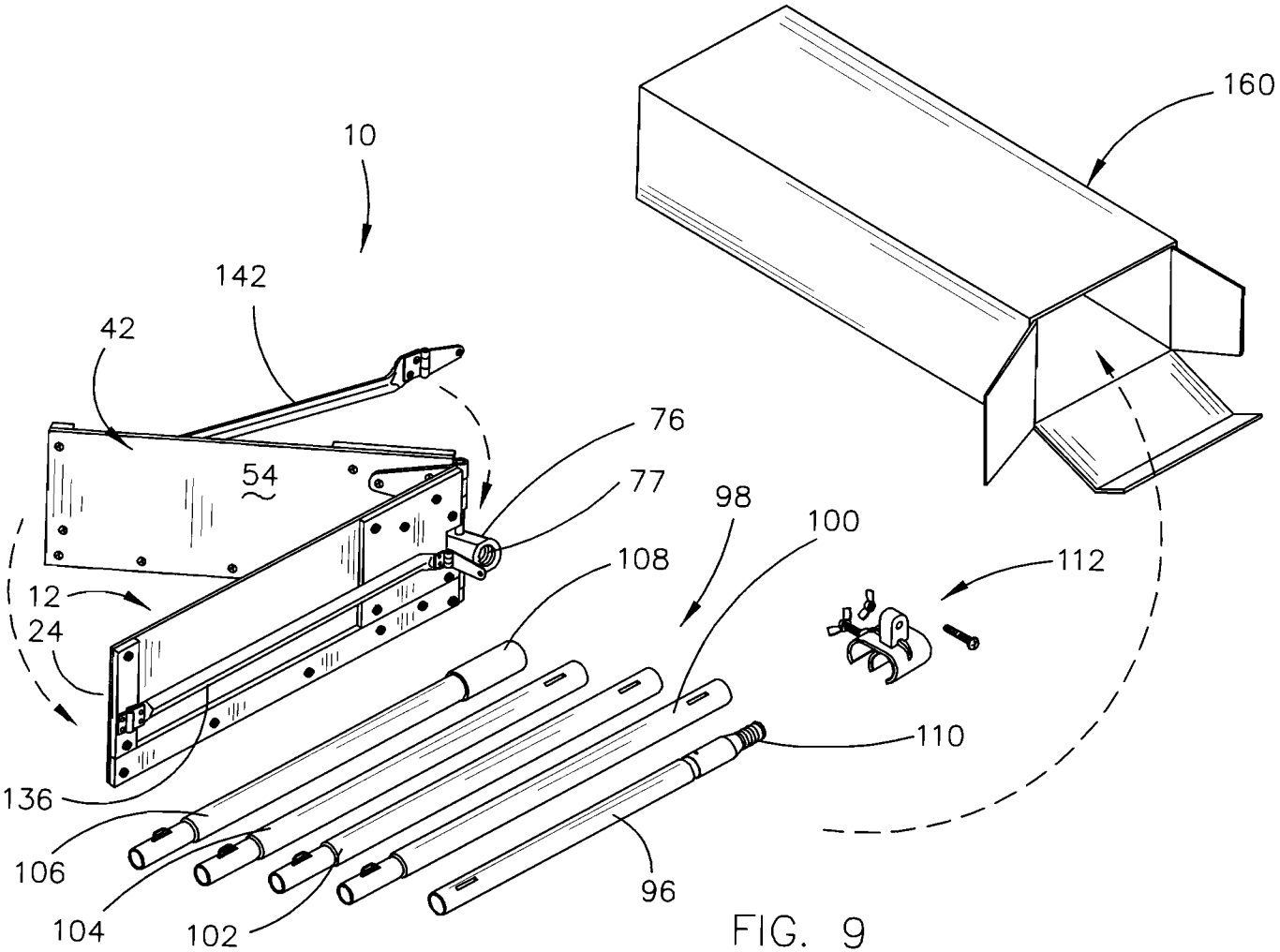
FIG. 9 is a perspective view which illustrates that the snow rake of this invention may be disassembled and placed in a box for shipment or storage.

The snow rake 10 may be collapsed and/or folded for shipment, display or storage as will now be described. The inner ends of arms 136 and 142 are disconnected from support 112. The support 112 is then removed from the extension pole 98. The end 110 of pole section 96 is then disconnected from connector 76. The arm 136 is then hingedly moved with respect to rake member 12 so as to be positioned at the inner side of rake member 12 as shown in FIG. 9. The arm 142 is then hingedly moved with respect to rake member 42 so as to be positioned at the inner side of rake member 42. The rake members 12 and 42 are then folded so that the outer side of rake member 12 is positioned at the outer side of rake member 42. The pole sections 96, 100, 102, 104 and 106 are disconnected from one another. The components of snow rake 10 are then placed in the box 160 for display, shipment or storage.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A rake for moving snow from roofs, comprising:

an upstanding and elongated rectangular-shaped first rake member having an outer end, an inner end, an upper end, a lower end, an inner side and an outer side;

an upstanding and elongated rectangular-shaped second rake member having an outer end, an inner end, an upper end, a lower end, an inner side and an outer side;

said inner ends of said first and second rake members being hingedly secured together;

each of said first and second rake members being selectively hingedly movable between first and second positions;

said first and second rake members, when in said first position, being substantially parallel to one another in an end-to-end manner;

said first and second rake members, when in said second position, being angularly disposed with respect to one another;

a connector positioned between said inner ends of said first and second rake members and secured thereto;

an extension pole, having upper and lower ends;

said upper end of said extension pole being selectively secured to said connector;

an elongated and rigid first support arm having an inner end and an outer end;

said outer end of said first support arm being hingedly secured to said first rake member at said outer end of said first rake member;

said inner end of said first support arm being hingedly and selectively longitudinally adjustably secured to said extension pole;

said first support arm having a length which is less than the length of said first rake member;

an elongated and rigid second support arm having an inner end and an outer end;

said outer end of said second support arm being hingedly secured to said second rake member at said outer end of said second rake member;

said inner end of said second support arm being hingedly and selectively longitudinally adjustably secured to said extension pole;

said second support arm having a length which is less than the length of said second rake member;

said inner ends of said first and second support arms being selectively detachable from said extension pole to permit said first and second rake members to be selectively moved outwardly to a third position and wherein said outer side of said first rake member is positioned adjacent said outer side of said second rake member when said first and second rake members are in said third position;

said first support arm being positioned adjacent said inner side of said first rake member when said first and second rake members are in said third position;

said inner end of said first support arm being spaced inwardly of said inner end of said first rake member when said first and second rake members are in said third position;

said outer end of said first support arm being spaced inwardly of said outer end of said first rake member when said first and second rake members are in said third position;

said second support arm being positioned adjacent said inner side of said second rake member when said first and second rake members are in said third position;

said inner end of said second support arm being spaced inwardly of said inner end of said second rake member when said first and second rake members are in said third position; and said outer end of said second support arm being spaced inwardly of said outer end of said second rake member when said first and second rake members are in said third position.

* * * * *